United States Patent [19]

Offterdinger

[11] 4,353,186

[45] Oct. 12, 1982

[54] RUNNER WHEEL ASSEMBLY

[76] Inventor: Hermoff F. Offterdinger, 602 Galway Dr., Burlington, Ontario, Canada

[21] Appl. No.: 191,120

[22] Filed: Sep. 26, 1980

Related U.S. Application Data

[63] Continuation-in-part of Ser. No. 59,012, Jul. 19, 1979.

[51] Int. Cl.[3] ..... E05D 13/02

[52] U.S. Cl. ..... 49/420; 49/425; 16/99; 16/105; 403/353

[58] Field of Search ..... 49/420, 421, 422; 403/348, 353, 354; 16/91, 103, 99, 105

[56] References Cited

U.S. PATENT DOCUMENTS

| | | | |
|---|---|---|---|
| 3,283,444 | 11/1966 | Andres | 49/920 |
| 3,331,161 | 7/1967 | Ruff | 49/397 |
| 4,006,513 | 2/1977 | Offterdinger | 49/425 X |
| 4,009,507 | 3/1977 | Lascarrou | 403/353 X |

*Primary Examiner*—Kenneth Downey

*Attorney, Agent, or Firm*—Hirons, Rogers & Scott

[57] ABSTRACT

A sliding door employing a runner wheel assembly of the invention typically comprises a frame of hollow extruded frame elements. The hollow section of the bottom frame element is provided with two such wheel assemblies, one at each end, supporting the door for sliding movement, each assembly comprising a wheel retainer member and a wheel carrier or support member releasably secured to the retainer member. In normal use the wheel carried by the wheel support member projects through an opening of the bottom frame element to cooperate with a track. When the door is lifted from the track the wheel support member can be pivoted relative to the retainer member to a position from which it can be removed and replaced through the opening. The wheel support consists of a unitary member providing a non-circular bearing part which is inserted into a keyhole shaped aperture in the wheel retainer while the support is in one orientation, the support thereafter being rotated to another orientation for retention in the wheel retainer.

9 Claims, 6 Drawing Figures

RUNNER WHEEL ASSEMBLY

CROSS REFERENCES TO RELATED APPLICATIONS

Reference is made to U.S. patent application Ser. No. 059,012, 7-19-79 of which the present application is a continuation-in-part.

FIELD OF THE INVENTION

This invention is concerned with a runner wheel assembly for use with sliding doors and windows, for example, screen doors and windows of the kind having frame elements of hollow extruded form.

REVIEW OF THE PRIOR ART

These doors usually comprise four lengths of an aluminum extrusion mitered at their ends and assembled, by means of L-shaped corner pieces into a rectangular frame, the limbs of the L-shaped corner pieces being received within hollow sections of the extrusions. The door is completed by a sheet of wire mesh, or by a sheet of glass or of transparent acrylic plastic supported in the frame. The L-shaped corner pieces at the two lower corners of the frame carry wheels or other roller elements which engage a track to guide the door in its sliding movement.

These wheels, being load bearing, are subject to wear and require to be replaced from time to time. Conventionally to replace a wheel the door is disassembled and reassembled using a new corner piece complete with a wheel.

In my U.S. patent application Ser. No. 4,006,513 issued Feb. 8, 1977, there is described a runner wheel support assembly which permits the easy removal and replacement of the wheel without requiring disassembly of the frame elements of the door. The structure described in that patent specification is effective to this end, but because of its complexity and resultant cost it has not achieved great acceptance and the most commonly used doors still require disassembly of the corners of the frame elements and the replacement of the corner pieces and wheels.

DEFINITION OF THE INVENTION

This invention seeks to provide a simple and inexpensive runner wheel assembly of which the wheel is easily replaced. The invention also seeks to provide a wheel assembly for use with doors, windows, etc. which permits the removal of the wheel and its replacement simply and quickly. The invention also seeks to provide a replacement wheel assembly which is simply and easily placed in position in a door, window or the like.

Thus, in accordance with the present invention there is provided a wheel assembly for a sliding door comprising an L-shaped corner piece the two limbs of which in use are received in respective adjacent hollow frame elements of the sliding door, said corner piece having in one limb thereof an aperture providing a circular female bearing surface, and a passage leading from the limb exterior to the aperture for the movement through the passage to the aperture of a male bearing member having a male bearing surface for cooperation with the said female surface, a wheel support member stamped from sheet metal to have two spaced parallel flanges integrally connected to one another, a runner wheel mounted by the spaced flanges in the space between them for rotation about a wheel axis, and a male mounting member mounted by the spaced flanges in the space between them, said male mounting member having two opposed part-circular male bearing surface portions constituting the said male bearing surface and connected by two opposed parallel chordal surface portions, the width of the male mounting member between the chordal surface portions being such as to permit passage of the male mounting member through the said passage, and so that upon rotation of the male mounting member in the said aperture to another orientation the wheel support member is pivotally mounted on the corner piece for rotation about an axis parallel to the wheel axis.

DESCRIPTION OF THE DRAWINGS

Particular preferred embodiments of the present invention will now be described by way of example, with reference to the accompanying drawings wherein.

DESCRIPTION OF THE PREFERRED EMBODIMENTS

Figures 1, 2:
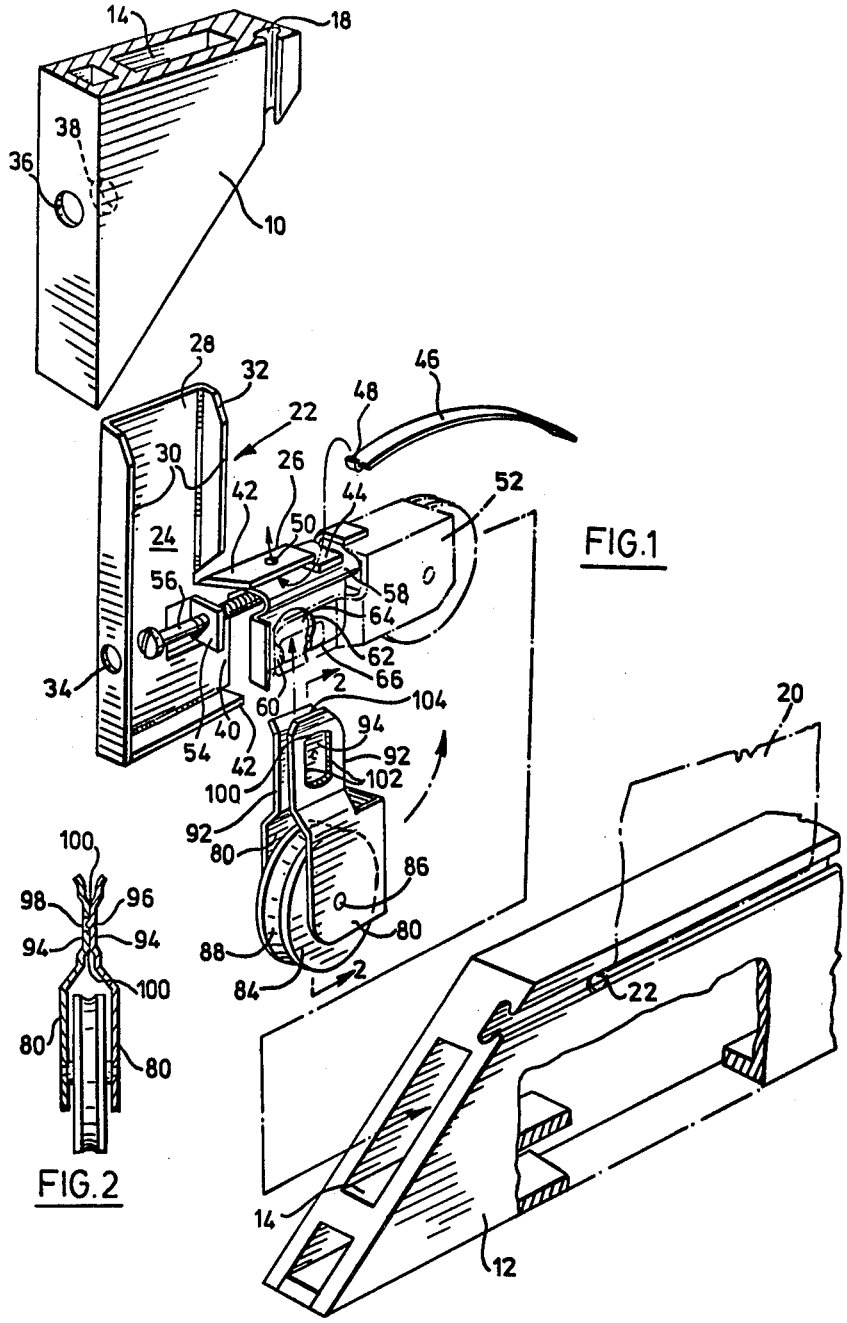
FIG. 1 is an exploded perspective view of a lower corner of a door employing a runner wheel assembly according to the present invention.
FIG. 2 is a cross-sectional view on the line 2—2 of FIG. 1.

A common form of sliding door is made up of four lengths of an extrusion, the corners of which are mitered so that the lengths or frame elements can be assembled into a rectangular frame. An upright frame element 10 is seen in FIG. 1, as is the abutting lower, horizontal frame element 12. The extrusion comprises a central hollow portion 14 and in one face thereof has a groove 18 within which, in the particular embodiment illustrated, the marginal edges of a wire screen 20 are secured by means of rods 22. The mitered corners of the frame elements are connected by an L-shaped corner piece indicated generally at 22 which, in a manner described hereinafter, serves also as a wheel retainer member. The vertical limb 24 of the corner piece is received within the hollow portion 14 of upright frame element 10 while the horizontal limb 26 is received within the corresponding hollow portion of frame element 12. The corner piece is formed as a single, unitary pressing of steel. Limb 24 comprises a web 28 with a pair of opposed parallel upstanding flanges 30 the leading edges of which are relieved as at 32 to assist in the insertion of the limb into the hollow portion 14 of frame element 10. The outer flange has an opening 34 which registers with openings 36 and 38 in the frame element 10 for a purpose to be described hereinafter.

Limb 26 comprises a web 40 with opposed parallel upstanding flanges 42. A portion 44 of the upper or inner flange 42 is pressed inwardly so that a leaf spring 46, as can be seen particularly in FIG. 3, can be secured between the undersides of the portions of flange 42 to each side of portion 44 and the top surface of portion 44. The leaf spring has a tang 48 which is received in a corresponding opening 50 formed in flange 42. As described hereinafter, the end region of the spring remote from tang 48 bears upon a wheel support member indicated generally at 52.

Figure 4:
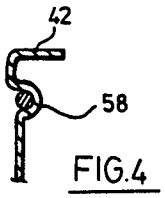
FIG. 4 is a section on the line 4—4 of FIG. 3.

A tab 54 is pressed out at the junctions of the webs 28 and 40 of the corner piece and has a central threaded opening within which a screw 56 is secured. The aligned openings 34 of the corner piece and 36 and 38 of the frame element 10 permit access to the screw head by a screwdriver for adjusting the screw for a purpose described hereinafter. The web 40 of limb 26 of the corner piece is pressed to form a guide 59 for the screw 36, the form of which guide is seen particularly in FIG. 4. As can be seen particularly in FIG. 1 a portion 60 of the web 40 is provided with a keyhole-shaped aperture providing a circular female bearing surface 62 and having a passage 64 of lesser width than the diameter of surface 62, the passage 64 leading from edge 66 of portion 60 to the bearing surface 62.

Figure 5:
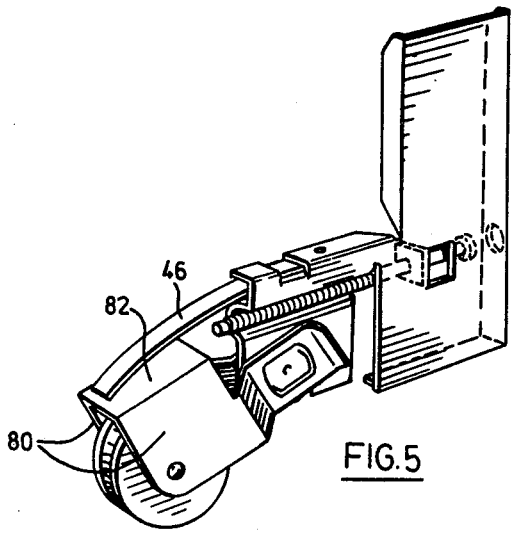
FIG. 5 is a perspective view of the wheel assembly of FIGS. 1 and 3 from the opposite side to those figures.

A wheel support member of the assembly is formed from a single pressing and comprises a pair of opposed flanges 80 which are connected, as can be seen particularly in FIG. 5, by a web portion 82. A wheel 84 is rotatably mounted between the flanges on pin 86. The rim of the wheel is grooved at 88 for cooperation with an upstanding rib-like guide 90 on the sill of an associated door frame (see FIG. 1). Extensions 92 of the flanges 80 are brought together to one side of the wheel and upsets 94 are formed in those extensions. An upstanding pip 96 is formed in a central region of one of the upsets and a corresponding hole 98 is formed in the opposed portion of the other upset so that as the upsets are brought together they are positively aligned with one another. The upsets are then positively fastened to one another, for example by spot welding, to provide a sufficiently rigid member.

Figure 3:
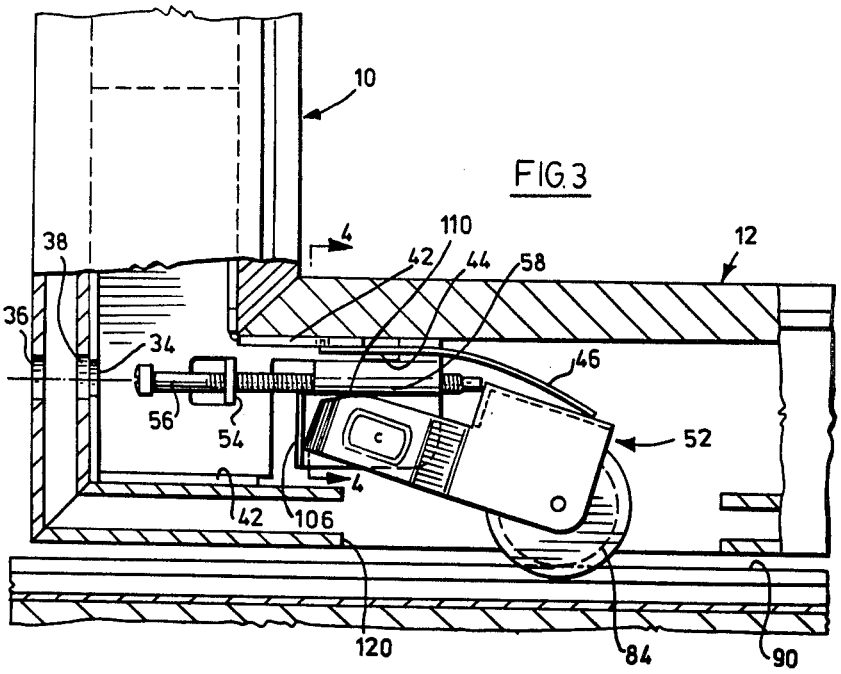
FIG. 3 is a part elevation, part cross-section corresponding to FIG. 1 of a lower corner of an assembled door.

The butting upsets define a pair of diametrically opposed coaxial arcuate bearing surfaces 100 which are separated by a pair of parallel chordal surfaces 102. These bearing surfaces are visible in the drawings but are defined respectively by the opposite sides of the depressed portions of the butting upsets. Thus the coaxial bearing surfaces 100 constitute male bearing surfaces and can be engaged with the circular female bearing surface 62 of the corner piece. The spacing between the chordal surfaces 100 of the upsets is such that in the orientation of the wheel support member shown in solid lines in FIG. 1 the upsets may be passed through the passage 64 until it reaches a first, inoperative position in which the leading male bearing surface 100 of the wheel support member engages with the female bearing surface 62 of the corner piece. If the wheel support member is now moved from this orientation to that shown in chain dot lines, constituting a second operative position of the support member, it will be apparent that the wheel support member is retained in the corner piece and, being thereby secured thereto, cannot be removed through the passage 62. An edge 104 of one of the extensions 92 is arranged to interfere with a projecting portion 106 of the part of the web 40 containing the keyhole aperture so that, in moving the wheel support member between horizontal and vertical positions, as seen in FIGS. 1 and 3, the edge 104 binds against the surface of the portion 106, thus resisting such movement and preventing inadvertent movement between those two positions. The lower surface of the lower extrusion part 12 has an opening 108 through which the wheel 84 projects.

In assembling a door the frame elements are united by the corner piece while the wheel support member is separated from that corner piece. Upon assembly of the frame elements the wheel support member is engaged with a corner piece through the opening 120 as described above, while in the orientation shown in full lines in FIG. 1. Thereafter the wheel support member is pivoted counterclockwise as viewed in FIGS. 1 and 3, past the position in which binding of the edge 104 and surface 106 occurs, to the position shown in FIg. 3. In that position the edge of the wheel projects through the opening 120 and there engages upon the guide 90 to support the door for its sliding movement. The screw 56 is adjusted to limit the upward pivoting movement of the wheel support member about the bearing surfaces 100 and 62 and against the urge of the spring 46 by the leading end of the screw engaging against an adjacent portion of the support member.

If it becomes necessary to replace the wheel 84, the door is lifted from the track 90 and the support member 52 is pivoted clockwise as viewed in FIG. 3, so that the chordal portions 102 of the butting upsets are aligned with the passage 64 of the keyhole aperture. In this orientation the male bearing surfaces of the support member can be disengaged from the corresponding female surfaces of the retainer member of the corner piece. A replacement wheel may then be placed in position by reversing that procedure.

Figure 6:
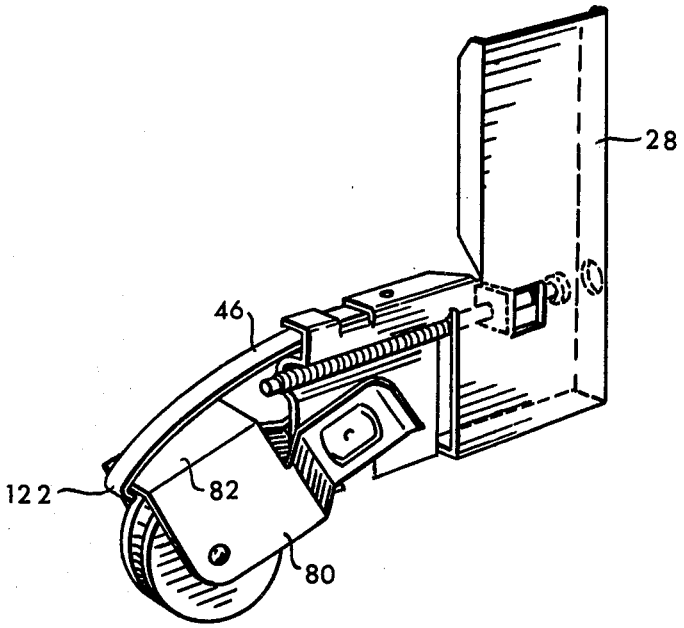
FIG. 6 is a view similar to FIG. 5 of a second embodiment.

In the embodiment illustrated by FIG. 6 the wheel support member is retained approximately in the horizontal position by means of a hook member 122 formed at the free end of the spring 46, this hook member being engaged with an edge of the web portion 82 of the wheel support member. This hook replaces the interference fit between the edge 104 and portion 106. It will be seen that the wheel can move upwards against the bias of the spring but cannot drop below the position set by the spring.

It will be recognized that the present invention provides a simple and effective solution to the problem of easy replacement of the wheel of a sliding door. Specifically, it provides an assembly of relatively few and very simple parts. Essentially the device comprises two simple pressings which have integral, matching bearing surfaces, a spring, a screw and a wheel. It will be recognized that the basic components are subject to modifications which do not deviate from the scope of the invention as defined in the appended claims.

I claim:

1. In a sliding door comprising a bottom frame element of hollow cross section, having an opening in a bottom surface of said frame element extending to a hollow portion of said section, the provision of a wheel retainer member received within the said hollow portion, a wheel rotatably mounted in a support member, said support member being movably mounted on said retainer member and rotatable between one orientation in which it projects through said opening to support said door in its sliding movement and in which it is retained by said retainer member and another orientation in which it may be removed through said opening and disengaged from said retainer member, said support member being guided in said movement by bearing surfaces formed integrally with the said retainer member and said support member, wherein said support member comprises two opposed flanges between which said wheel is mounted, at least one of said flanges having an upset portion extending towards the other of said flanges and defining one of said bearing surfaces which is a male bearing surface comprising two spaced, coaxial, part-circular surfaces separated by two substantially parallel chordal surfaces and wherein a passage leads to the upper bearing surface which is a female bearing surface of said corner piece said passage being wider than the space in between the chordal surfaces and less wide than the diameter of said circular surfaces whereby in said one orientation said upset may pass through said passage and in said orientation is prevented from passing through said passage.

2. In a sliding door comprising a bottom frame element of hollow cross section, having an opening in a bottom surface of said frame element extending to a hollow portion of said section, the provision of a wheel retainer member received within the said hollow portion, a wheel rotatably mounted in a support member, said support member being movably mounted on said retainer member and rotatable between one orientation in which it projects through said opening to support said door in its sliding movement and in which it is retained by said retainer member and another orientation in which it may be removed through said opening and disengaged from said retainer member, said support member being guided in said movement by bearing surfaces formed integrally with the said retainer member and said support member, wherein said support member comprises two opposed flanges between which said wheel is mounted, wherein said flanges have matching upset portions, together defining one of the bearing surfaces which is a male bearing surface comprising two spaced, coaxial, part-circular surfaces separated by two substantially parallel chordal surfaces and wherein a passage leads to the other bearing surface which is a female bearing surface of said corner piece, said passage being wider than the space in between the chordal surfaces and less wide than the diameter of said circular surfaces whereby in one orientation said upset may pass through said passage and in another orientation is prevented from passing through said passage.

3. In a door as claimed in claim 1 or 2 wherein the support member is formed as a single pressing.

4. In a door as claimed in claim 1 or 2 wherein means resisting movement of said support member between said one orientation and said other orientation comprises a spring member urging the support member toward said other orientation and having a hook portion engaging the support member to inhibit its movement into said one orientation.

5. A wheel assembly for a sliding door comprising an L-shaped corner piece the two limbs of which in use are received in respective adjacent hollow frame elements of the sliding door, said corner piece having in one limb thereof an aperture providing a circular female bearing surface, and a passage leading from the limb exterior to the aperture for the movement through the passage to the aperture of a male bearing member having a male bearing surface for cooperation with the said female surface, a wheel support member stamped from sheet metal to have two spaced parallel flanges integrally connected to one another, a runner wheel mounted by the spaced flanges in the space between them for rotation about a wheel axis, and a male mounting member mounted by the spaced flanges in the space between them, said male mounting member having two opposed part-circular male bearing surface portions constituting the said male bearing surface and connected by two opposed parallel chordal surface portions, the width of the male mounting member between the chordal surface portions being such as to permit passage of the male mounting member through the said passage, and so that upon rotation of the male mounting member in the said aperture to another orientation the wheel support member is pivotally mounted on the corner piece for rotation about an axis parallel to the wheel axis.

6. A wheel assembly as claimed in claim 5, wherein said male mounting member is constituted by upsets in the two parallel flanges extending toward one another, the marginal edges of the said upsets constituting the said male bearing surface portions and the connecting chordal surface portions.

7. A wheel assembly as claimed in claim 6, wherein the said upsets are spot welded to one another.

8. A wheel assembly as claimed in any one of claims 5, 6 or 7, and including a leaf spring member mounted by the L-shaped corner piece and having a portion thereof resiliently engaging the said wheel support assembly to urge the assembly for pivotal rotation about its said axis toward a surface on which the runner wheel is to run.

9. A wheel assembly as claimed in any one of claims 5, 6 or 7, and including a leaf spring member mounted by the L-shaped corner piece and having a portion thereof resiliently engaging the said wheel support assembly to urge the assembly for pivotal rotation about its said axis toward a surface on which the runner wheel is to run, the said leaf spring member having a disengagable hook portion at the end thereof disengagably hooked onto the said wheel support assembly to hold it against pivotal rotation to an orientation in which the wheel support member can be removed from the L-shaped corner piece without disengagement of the hooked portion.

* * * * *